US009032924B2

(12) United States Patent
Busse

(10) Patent No.: US 9,032,924 B2
(45) Date of Patent: May 19, 2015

(54) CAMSHAFT ADJUSTER

(75) Inventor: Michael Busse, Herzogenaurach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 7 days.

(21) Appl. No.: 14/119,365

(22) PCT Filed: Mar. 28, 2012

(86) PCT No.: PCT/EP2012/055546

§ 371 (c)(1),
(2), (4) Date: Nov. 21, 2013

(87) PCT Pub. No.: WO2013/007402

PCT Pub. Date: Jan. 17, 2013

(65) Prior Publication Data

US 2014/0102392 A1 Apr. 17, 2014

(30) Foreign Application Priority Data

Jul. 14, 2011 (DE) ..... 10 2011 079 183

(51) Int. Cl.
*F01L 1/344* (2006.01)

(52) U.S. Cl.
CPC ..... *F01L 1/344* (2013.01); *F01L 2001/34493* (2013.01); *F01L 1/3442* (2013.01)

(58) Field of Classification Search
CPC ..... F01L 2001/34486; F01L 2001/0475; F01L 2001/3443; F01L 2001/34426; F01L 2001/34446; F01L 1/3442; F01L 2001/34433; F01L 2001/34493; F01L 2001/34496
See application file for complete search history.

(56) References Cited

U.S. PATENT DOCUMENTS

| | | | | |
|---|---|---|---|---|
| 8,051,818 | B2 * | 11/2011 | Myers et al. | 123/90.17 |
| 2009/0173297 | A1 | 7/2009 | Hutcheson et al. | |
| 2009/0183702 | A1 | 7/2009 | Knecht et al. | |
| 2009/0314235 | A1 | 12/2009 | Rozario et al. | |
| 2010/0093453 | A1 | 4/2010 | Myers | |
| 2012/0235518 | A1 * | 9/2012 | Hentsch et al. | 310/37 |
| 2013/0000576 | A1 * | 1/2013 | Tanaka et al. | 123/90.15 |
| 2013/0284132 | A1 * | 10/2013 | Watanabe et al. | 123/90.15 |
| 2013/0306011 | A1 * | 11/2013 | Wigsten et al. | 123/90.15 |
| 2014/0190435 | A1 * | 7/2014 | Wigsten et al. | 123/90.17 |

FOREIGN PATENT DOCUMENTS

| | | |
|---|---|---|
| DE | 10 2008 033230 | 7/2009 |
| DE | 10 2009 041755 | 4/2010 |
| GB | 2 472 054 | 1/2011 |
| WO | WO 2008/157076 | 12/2008 |
| WO | WO 2009/005999 | 1/2009 |

* cited by examiner

*Primary Examiner* — Thomas Denion
*Assistant Examiner* — Daniel Bernstein
(74) *Attorney, Agent, or Firm* — Davidson, Davidson & Kappel, LLC

(57) ABSTRACT

An arrangement of a camshaft phaser (1) which allows a variable pressure boost in that a rotary piston (7) of the camshaft phaser (1) either creates or eliminates a fluid connection between a first pair of working chambers and a second pair of working chambers arranged in the axial direction (23).

11 Claims, 10 Drawing Sheets

CAMSHAFT ADJUSTER

The invention relates to a camshaft phaser.

BACKGROUND

Camshaft phasers are used in internal combustion engines in order to vary the timing of the combustion chamber valves so that the phase relation between the crankshaft and the camshaft can be configured variably within a defined angular range between a maximum early position and a maximum late position. Adapting the timing to the current load and rotational speed lowers fuel consumption and reduces emissions. For this purpose, camshaft phasers are integrated into a power train via which a torque is transmitted from the crankshaft to the camshaft. This power train can be configured, for instance, as a belt drive, chain drive or gear drive.

In a hydraulic camshaft phaser, the driven element and the drive element form one or more pairs of pressure chambers that counteract each other and that can be pressurized with oil. Here, the drive element and the driven element are arranged coaxially. A relative movement between the drive element and the driven element is generated by filling and emptying individual pressure chambers. The spring, which has a rotational effect between the drive element and the driven element, forces the drive element relative to the driven element in a preferential direction. This preferential direction can be the same as or opposite to the direction of rotation.

A widespread design of the hydraulic camshaft phaser is the vane-type adjuster. Vane-type adjusters have a stator, a rotor and a drive element. The rotor is usually non-rotatably joined to the camshaft and forms the driven element. The stator and the drive element are likewise non-rotatably joined to each other and, if applicable, are configured in one piece. Here, the rotor is located coaxially to the stator and inside the stator. The rotor and the stator, with their radially extending vanes, form oil chambers that counteract each other, that can be pressurized with oil and that permit a relative movement between the stator and the rotor. Moreover, the vane-type adjusters have various sealing covers. The stator, the drive element and the sealing cover are secured by means of several screwed connections.

Another familiar design of hydraulic camshaft phasers is the axial piston-type phaser. Here, oil pressure serves to axially move a sliding element whose helical gearing generates a relative rotation between a drive element and a driven element.

U.S. Pat. Appln. No. 2009/0173297 A1 discloses a hydraulic camshaft timing device that has a drive gear and, coaxially thereto, a stator with two rotors arranged concentrically to the stator. The stator is configured in one piece or else made up of several components. The rotors and the stator have radially oriented vanes. Owing to these vanes, the stator, together with the rotors, forms working chambers that can be pressurized with a hydraulic medium, so that a relative rotation around the rotational axis of the camshaft phasing device occurs between the appertaining rotor and the stator. A partition wall that is arranged between the rotors separates the rotors axially from each other. Each rotor can be connected to a camshaft. In this case, the camshaft is configured as a hollow shaft, whereas the other camshaft is made of solid material. Both camshafts are arranged concentrically with respect to each other. The cams that are correspondingly associated with the camshafts are joined to their camshaft in such a way that a relative circumferential rotation of the cams or of the individual camshafts can occur relative to each other, so that the timing of the inlet and outlet valves associated with the cams can be adjusted continuously and variably.

The vanes of the rotors and the vanes of the stator have an effective surface which is exposed to pressure when the working chambers are being filled with a hydraulic medium, and thus it is exposed to a force in the circumferential direction that gives rise to the relative rotation. The response behavior of such a hydraulic camshaft phaser is determined by this surface and by the pressure of the hydraulic medium that is generated by a pressure-medium pump.

SUMMARY OF THE INVENTION

It is an object of the present invention to provide a camshaft phaser that has a variable pressure boost.

The present invention provides that the drive element, the first driven element and the second driven element are arranged coaxially to each other via their appertaining rotational axes. The three elements can be arranged one after the other or nested along their shared rotational axis, which coincides with the rotational axis of the camshaft phaser.

In contrast to the coaxial arrangement, in the case of an axis-parallel arrangement of the rotational axis of the rotary piston with respect to the rotational axis of the camshaft phaser, the rotational axis of the rotary piston is at a distance from the rotational axis of the camshaft phaser, but both axes run virtually parallel to each other. The coaxial arrangement, in contrast, means that the rotational axes are flush with each other.

A concentric arrangement entails the flush arrangement of the rotational axes, whereby, in addition, one element largely surrounds or envelops the other element.

A first pair of working chambers is formed by the first driven element together with the drive element. The vanes of the driven element and of the drive element separate the first pair into two working chambers which counteract each other. The vanes are configured in one piece in the radial direction or else separately with the drive element and/or with the first driven element.

A second pair of working chambers is formed by the second driven element together with the drive element. The vanes of the driven element and of the drive element separate the second pair into two working chambers which counteract each other. The vanes are configured in one piece in the radial direction or else separately with the drive element and/or with the second driven element.

The drive element can have several, separate stator parts and, for example, a sprocket gear, which are positively, non-positively or adhesively joined to each other, or else it can be made up of these components in one piece.

The two driven elements have hydraulic-medium channels. Hydraulic medium can be fed into or discharged from the working chambers through these hydraulic-medium channels. The hydraulic medium can fed in or discharged via the same hydraulic-medium channel or else via two separate hydraulic-medium channels associated with the feed and the discharge, respectively.

The first pair of working chambers of the one driven element or the second pair of working chambers of the other driven element is controlled by a control valve, especially by a proportional valve which, in turn, is supplied by a source of hydraulic medium. The first pair of working chambers is connected to the second pair of working chambers via hydraulic-medium channels that are formed by the driven elements themselves. The rotary piston controls the flow of hydraulic medium through these hydraulic-medium channels in that it can additionally connect the second pair of working chambers to the first pair of working chambers.

As result, one of the pairs of working chambers is continuously supplied with hydraulic medium under pressure and can ensure the adjustment of the camshaft phaser. The other pair of working chambers, which can be connected additionally by the rotary piston, achieves a variable pressure boost that can be adapted to the output supplied by the source of hydraulic medium.

In one embodiment of the invention, the rotary piston is actuated by hydraulic medium under pressure, preferably by the hydraulic-medium pressure from one of the hydraulic-medium channels leading to the working chambers. When the hydraulic-medium pressure increases, the rotary piston rotates around its rotational axis, which preferably coincides with the rotational axis of the camshaft phaser. The rotary piston opens the hydraulic-medium channels of the driven elements leading to the other pair of working chambers so that fluid can flow through, or else the rotary piston closes these channels.

In one embodiment of the invention, the rotary piston connects the first pair of working chambers to the second pair of working chambers so that fluid can flow through. Advantageously, a larger surface that is active in the circumferential or adjustment direction is provided by the additional vanes of the second pair of working chambers, as a result of which, for example, the adjustment can be carried out at a lower hydraulic-medium pressure.

In an optional embodiment, the rotary piston connects the two working chambers of the first pair of working chambers to each other and/or connects the two working chambers of the second pair of working chambers to each other so that fluid can flow through. When non-return valves are employed in this fluid-conveying connection, the adjustment can be achieved by assisting the camshaft alternating torques (CTA mode or cam-torque-actuated mode). If a camshaft alternating torque is present in one direction, then the hydraulic medium is displaced out of the one working chamber into the other working chamber of the same pair of working chambers. When the direction of the camshaft alternating torque is reversed, the non-return valve captures the hydraulic medium in one working chamber, as a result of which a hydraulic and virtually incompressible cushion is created. This re-routing is either permitted or prevented by the rotary piston. The rotary piston is preferably actuated by the hydraulic-medium pressure of one of the hydraulic-medium channels. Optionally, the non-return valve can be configured in one piece together with the rotary piston.

In an optional embodiment of the invention, the rotary piston can connect the one working chamber of the first pair of working chambers to the counteracting working chamber of the second pair of working chambers. Such a configuration is advantageous, for example, for actuating two concentric camshafts that are arranged so as to be rotatable with respect to each other, whereby each camshaft is advantageously associated with a driven element (cam-in-cam). In each case, one driven element is non-rotatably joined to the corresponding camshaft and an adjustment in the opposite rotational directions can be achieved.

In a preferred embodiment, both driven elements are non-rotatably coupled to each other. Advantageously, this allows the utilization of the variable pressure boost. This coupling can be configured so as to be permanent, for instance, through screwed connections, through a one-piece configuration of the two driven elements or else through welding, gluing, pinning, etc.

As an alternative, this coupling can be cancelled during operation when configured as a latching mechanism. This lends itself, for example, when two concentric camshafts are arranged so as to be rotatable with respect to each other, whereby each camshaft is associated with a driven element and is non-rotatably joined to it (cam-in-cam). If the driven elements, and thus also the two camshafts, are non-rotatably coupled during operation on an as-needed basis, this prevents the two camshafts from moving with respect to each other but not with respect to the crankshaft. If the driven elements, and thus also the two camshafts, are uncoupled during operation on an as-needed basis and are rotatable relative to each other, then the camshafts can be moved with respect to each other.

In an especially preferred embodiment, the rotary piston is arranged coaxially to one of the driven elements or to the drive element. "Coaxially" means that there is no perpendicular distance between two axes. The rotational axis of the rotary piston essentially coincides with the rotational axis of the camshaft phaser. Advantageously, this translates into a compact design. In addition, the rotary piston can be surrounded by one of the driven elements or by the drive element. This advantageously utilizes the installation space in the hub of the driven element or of the drive element.

In one embodiment of the invention, the rotary piston is moved into its resting position by means of at least one spring element. The spring element is arranged in such a way that the rotary piston can be rotated around its rotational axis by means of this spring force. The resting position of the rotary piston is the non-actuated state of the rotary piston. In its resting position, the rotary piston can keep the hydraulic-medium channels open or closed.

An alternative embodiment provides for the use of several spring elements that counteract each other. The resting position of the rotary piston is achieved by spring forces acting in the circumferential direction and it ends in a state of equilibrium owing to the counteracting effect of the spring forces. As a consequence, the rotary piston is held in its resting position by at least two spring means.

In another embodiment of the invention, at least one spring means for a circumferential force is provided, whereby the rotary piston has an angular stop that serves to delimit its rotational movement along the circumference. This angular stop is preferably configured in one single piece consisting of one of the driven elements or the drive element. Multi-part configurations of the angular stop using materials that differ from those of the driven element or drive element are conceivable.

In one embodiment of the invention, the camshaft phaser has a latching mechanism that can non-rotatably couple one of the driven elements to the drive element. A latching mechanism comprises a locking element that can preferably be brought into a locking position by a spring means, whereby in this locking position, one of the driven elements is non-rotatably coupled to the drive element. In order for an unlocked position of the locking element to be reached so that one of the driven elements can be moved relative to the drive element, preference is given to using a hydraulic medium. The latching mechanism can be arranged in a driven element or in the drive element.

In an advantageous embodiment, the rotary piston is mounted on the camshaft of the camshaft phaser. The rotary piston can be mounted on the outer diameter of the camshaft or on the inner diameter of the camshaft. The supply of hydraulic medium through the camshaft gives such an arrangement the advantage of forming simple and short hydraulic-medium channels.

BRIEF DESCRIPTION OF THE DRAWINGS

Embodiments of the invention are depicted in the figures. The following is shown.

DETAILED DESCRIPTION

Figure 1:
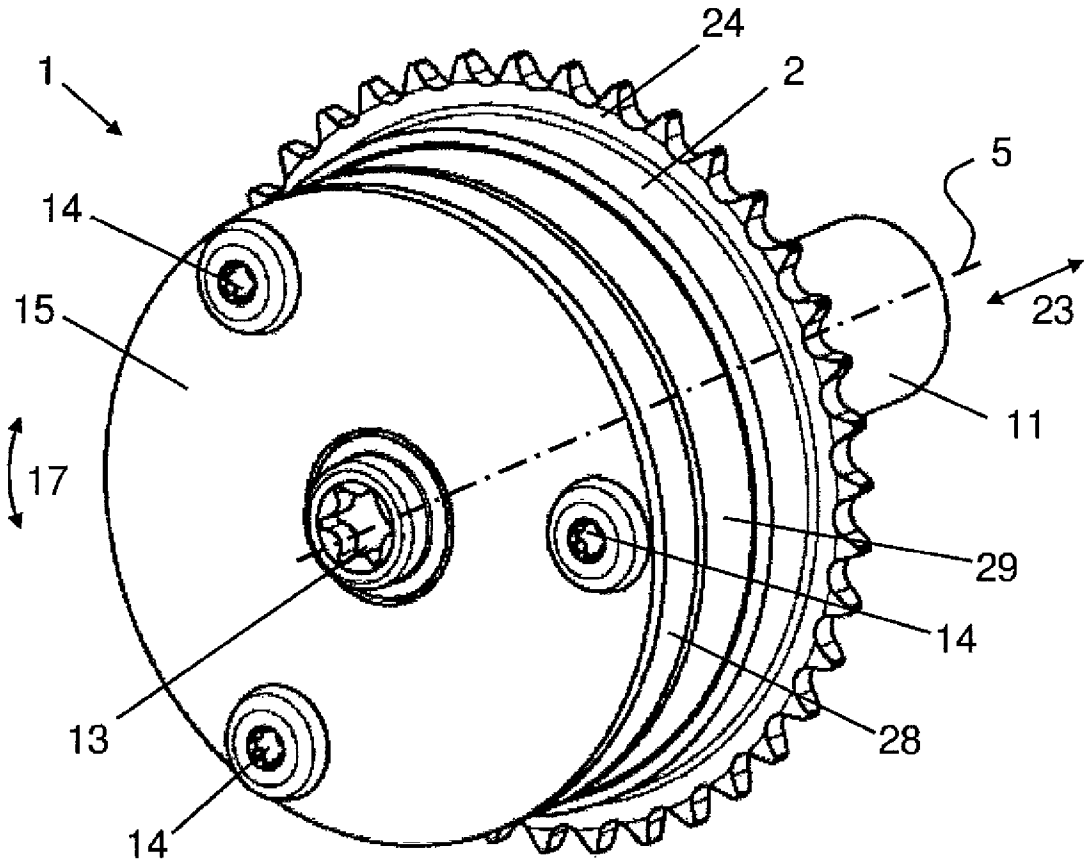
FIG. 1 a camshaft phaser.

FIG. 1 shows a camshaft phaser 1 with a drive element 2. The camshaft phaser 1 has a rotational axis 5, whereby this rotational axis 5 is, at the same time, the rotational axis of the camshaft 11. The extension of the rotational axis 5 defines the axial direction 23. The outer circumference of the drive element 2 has teeth in order to create a driving connection to the crankshaft by means of a chain. In this embodiment, the drive element 2 comprises a sprocket gear 24 having the teeth, and a stator, which is divided into a first and a second stator part 28, 29, respectively. The two similar stator parts 28, 29 will be elaborated upon in greater depth below. Several screws 14 join the sprocket gear 24 to the two stator parts 28, 29 firmly in the axial direction 23 and non-rotatably in the circumferential direction 17, thus forming the unit of the drive element 2.

During operation, the camshaft phaser 1 and the camshaft 11 rotate jointly around the rotational axis 5 in the circumferential direction 17. The camshaft phaser 1 is fastened to one end of the camshaft 11 by means of a central screw 13 extending in the axial direction 23. The central screw 13 non-rotatably fastens the two driven elements 3 and 4 to the camshaft 11. Moreover, on the side facing away from the camshaft, the camshaft phaser 1 has a disk 15 which, as a cover, largely seals off the working chambers A, B (not visible here) in the axial direction 23 vis-à-vis the environment. On the side facing the camshaft, the sprocket gear 24 seals off the working chambers C, D (not visible here) in the axial direction 23 vis-à-vis the environment.

Figure 2:
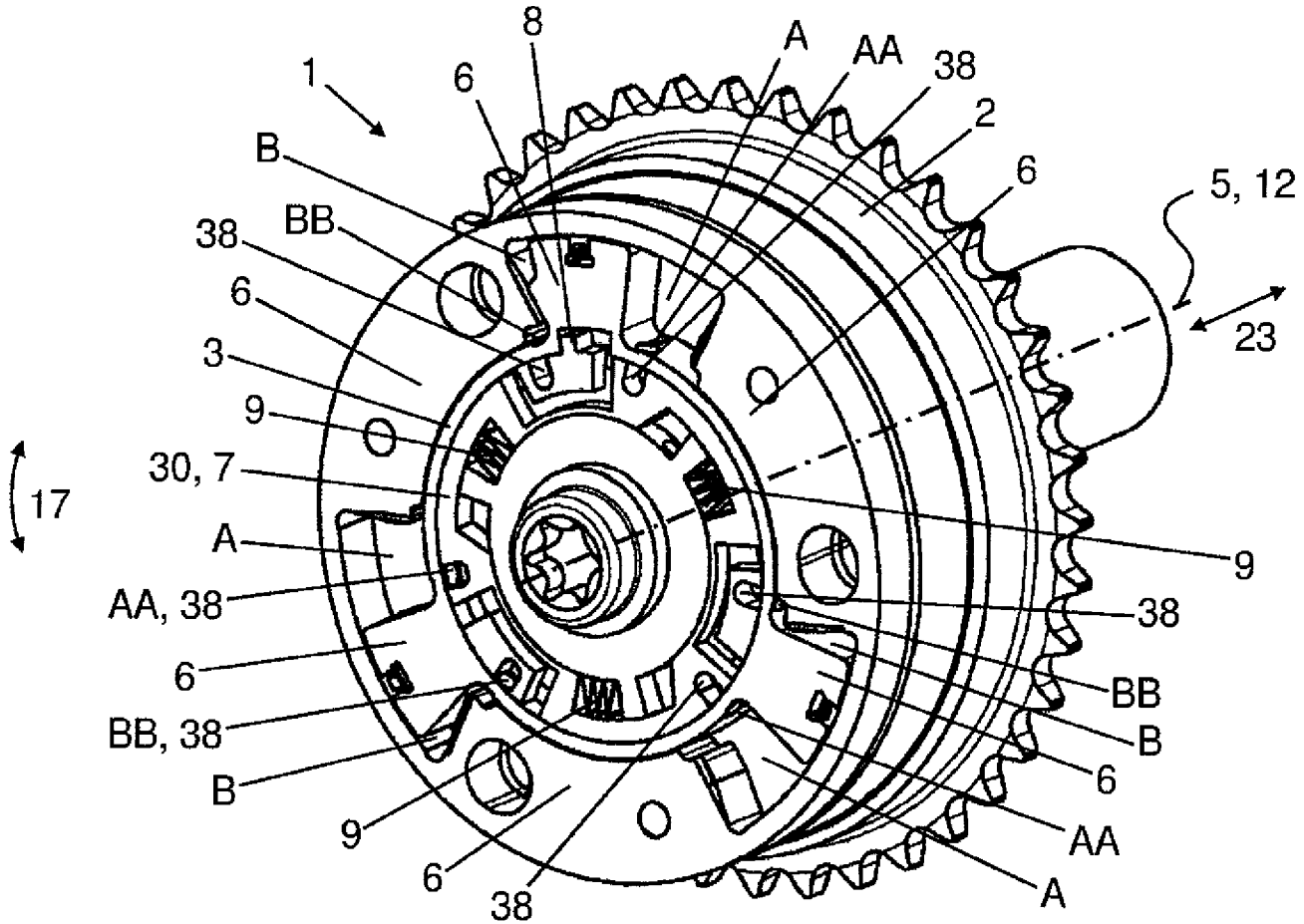
FIG. 2 a first section through the camshaft phaser according to FIG. 1.

FIG. 2 shows a first section through the camshaft phaser 1 according to FIG. 1, as seen in a view towards the first pair of working chambers formed by the working chambers A and B. Each of the appertaining stator parts 28, 29 of the drive element 2 is associated with the corresponding driven element 3, 4. The drive element 2 or the first stator part 28 has several radially oriented vanes 6 that, together with the vanes 6 of the first driven element 3, form the first pair of working chambers. On the outer circumference of the vanes 6 of the first driven element 3, there are spring-loaded sealing strips 16.

The rotary piston 7 is situated in the hub of the first driven element 3. For purposes of accommodating the rotary piston 7, the first driven element 3 has a groove 30 in the axial direction 23 into which the rotary piston 7 is inserted. The rotary piston 7 is configured as a ring-shaped element and it has recesses for the hydraulic-medium channels AA and BB. The first driven element 3 and the rotary piston 7 are arranged coaxially to each other. In the circumferential direction, there are several spring elements 9 that can rotate the rotary piston 7 relative to the first driven element 3 in the circumferential direction 17 and can bring the rotary piston 7 into its resting position when there is no hydraulic-medium pressure that would make the rotary piston 7 rotate with respect to the first driven element 3. Counteracting the spring elements 9, there are several actuation chambers 18 arranged between the first driven element 3 and the rotary piston 7. When these actuation chambers 18 are exposed to hydraulic-medium pressure, the rotary piston 7 rotates opposite to the spring force of the spring elements 9. This rotation is oriented relative to the first driven element 3 in the circumferential direction 17 and around the rotational axis 12 of the rotary piston 7. The rotational axis 12 is arranged coaxially to the rotational axis 5. Subsequently, the recesses 38 for the hydraulic-medium channels AA and BB are connected between the first pair of working chambers and the second pair of working chambers so as to convey fluid, whereby the second pair of working chambers is formed by the working chambers C and D (not visible here). Owing to the recesses 38 of the rotary piston 7, hydraulic medium is exchanged between the first pair of working chambers and the second pair of working chambers.

The rotary piston 7 also has a channel 19. The channel 19 conveys the hydraulic medium from the one working chamber A or B into the corresponding counteracting working chamber B or A, respectively.

An angular stop 8 delimits the adjustment angle between the rotary piston 7 and the first driven element 3. The angular stop 8 is joined firmly and in one piece to the rotary piston 7. The stop surface of the angular stop 8 cooperates in the circumferential direction 17 with a counter-surface of the vane 6 of the first driven element 3.

The first driven element 3 is manufactured without machining, for example, as a sintered part. Finishing work involving machining is necessary for various functional surfaces with an eye towards the precision levels that have to be attained for these functional surfaces. A complete production by means of machining is possible. Non-machining production methods include primary forming and deforming methods.

The rotary piston 7 is produced without machining, preferably as a sintered part, whereby finishing work involving machining of various functional surfaces cannot be ruled out. A complete production by means of machining is possible. Non-machining production methods include primary forming and deforming methods.

Figure 3:
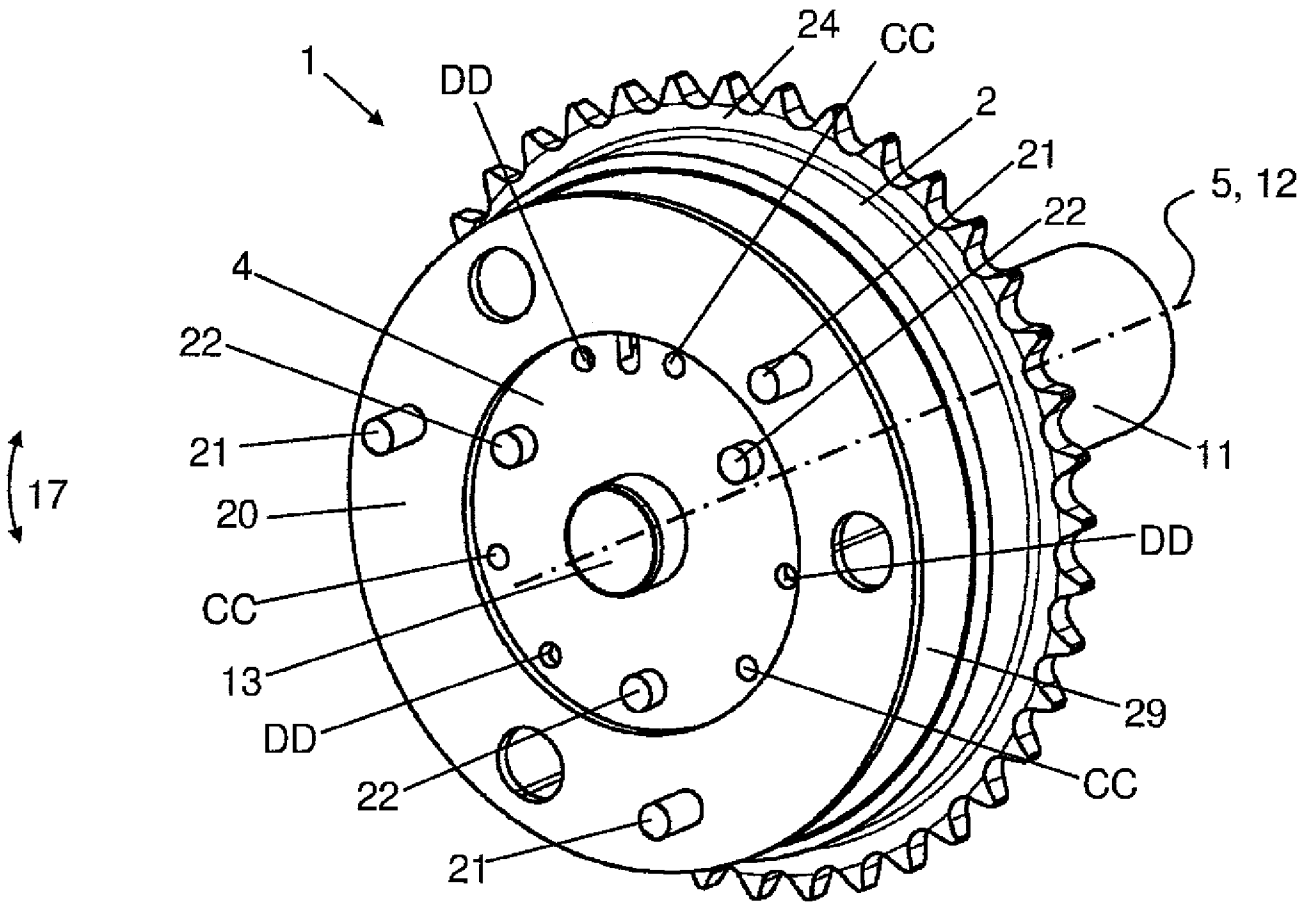
FIG. 3 a second section through the camshaft phaser according to FIG. 1.

FIG. 3 shows a second section through the camshaft phaser 1 according to FIG. 1. Between the first driven element 3 (no-longer visible here) and the second driven element 4, there is a gasket 20 that virtually separates the first pair of working chambers from the second pair of working chambers so that they are sealed tightly against hydraulic medium. The gasket 20 is configured in the form of a ring-shaped gasket and it has passage openings distributed along its circumference, whereby three pins 21 extend through several of these passage openings 2. These pins 21 non-rotatably connect the two stator parts 28, 29 of the drive element 2 to each other and to the gasket 20. Other passage openings of the gasket 20 are provided for the screws 14 shown in FIG. 1.

Three pins 22 distributed in the circumferential direction 17 non-rotatably join the first driven element 3 to the second driven element 4. Owing to the non-rotatable connection of the two driven elements 3 and 4 and the hydraulic-medium channel control, a pressure boost can be achieved by means of the rotor piston 7.

The second driven element 4 has hydraulic-medium channels CC and DD which are partially configured as bores that are axis-parallel to the rotational axis 5 or 12. Owing to their non-rotatable positioning between the driven elements 4 and 3 brought about by the pins 22, these bores open up into correspondingly arranged hydraulic-medium channels AA and BB of the first driven element 3.

Figure 4:
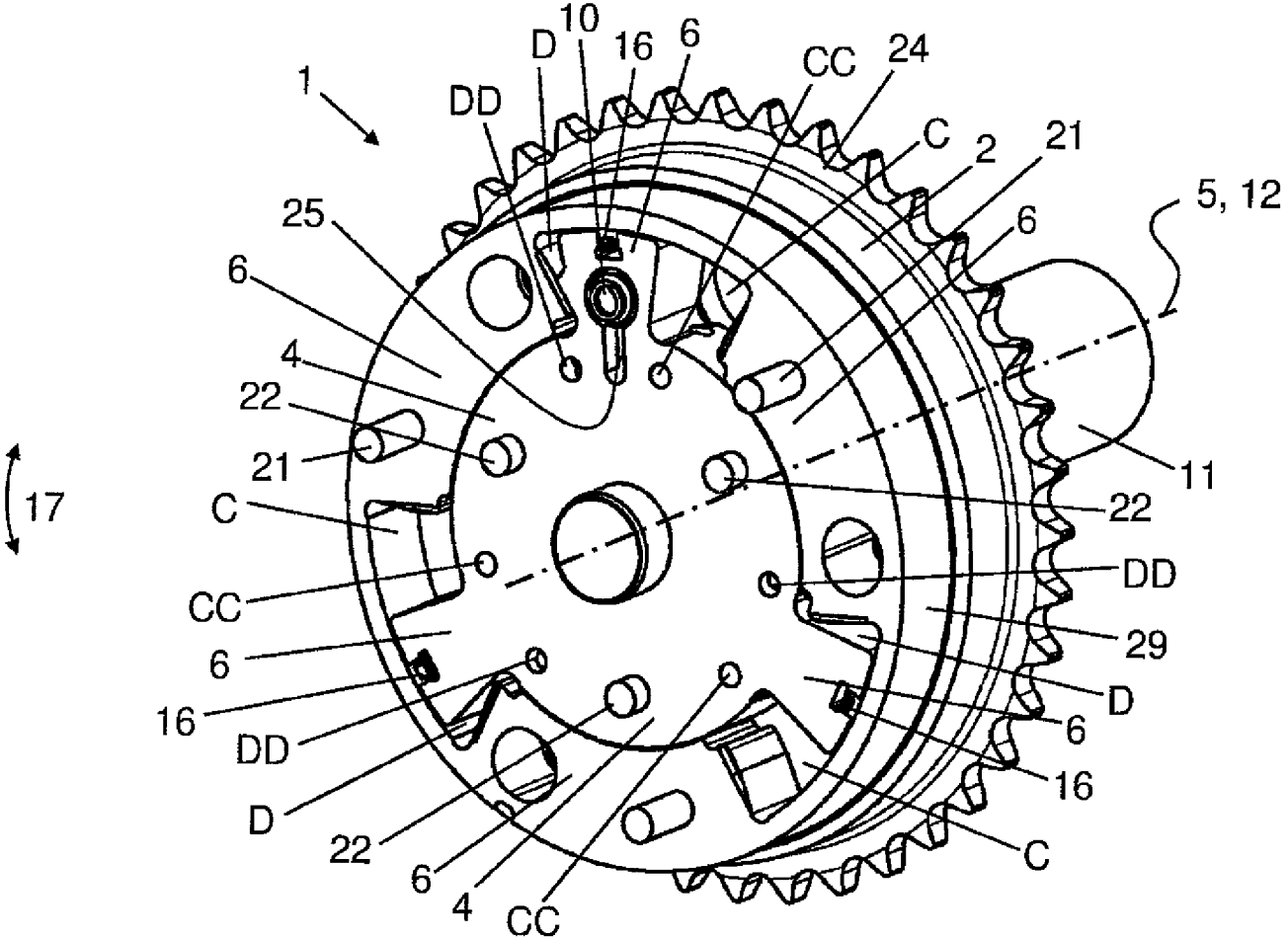
FIG. 4 a third section through the camshaft phaser according to FIG. 1.

FIG. 4 shows a third section through the camshaft phaser 1 according to FIG. 1, as seen in a view towards the second pair of working chambers formed by the working chambers C and D. The driven element 2 or the second stator part 29 has several radially oriented vanes 6 which, together with the vanes 6 of the second driven element 4, form the second pair of working chambers. On the outer circumference of the vanes 6 of the second driven element 4, there are spring-loaded sealing strips 16. The hydraulic-medium channels CC and DD are partially formed as parallel bores of the driven element 4.

One of the driven elements 3 or 4 has a latching mechanism 10. In the embodiment shown, the second driven element 4 has the latching mechanism 10 that is arranged in one of the vanes 6 of the second driven element 4. The latching mechanism 10 non-rotatably couples the driven elements 3 and 4 to the drive element 2 on an as-needed basis. In the uncoupled state, the driven elements 3 and 4 can rotate relative to the drive element 2 in the circumferential direction 17. In the embodiment shown, the latching mechanism 10 can engage with a latching link 34 of the sprocket gear 24 provided for this purpose.

Figure 5:
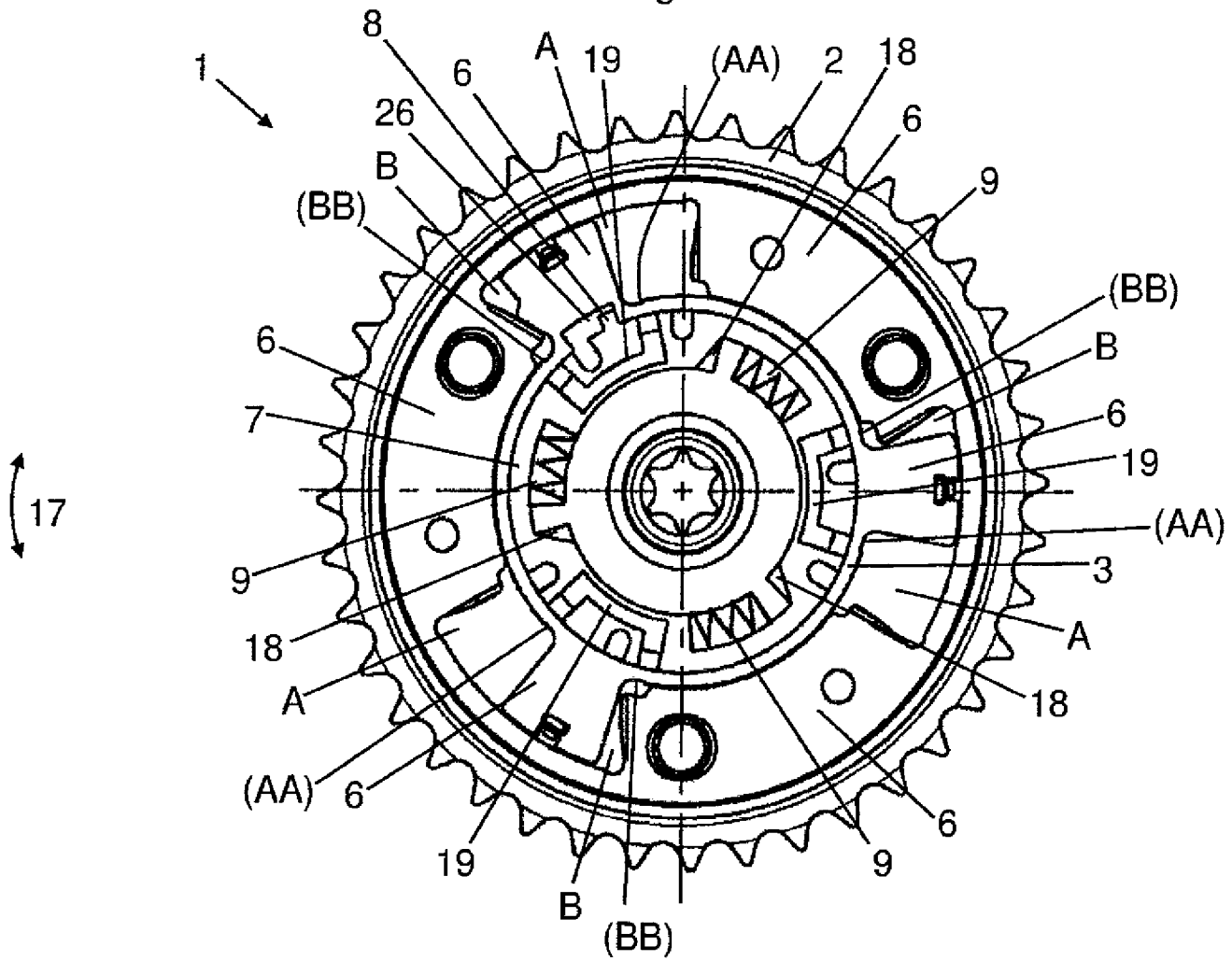
FIG. 5 a front view according to FIG. 2, with the rotary piston in the resting position.

FIG. 5 shows a front view according to FIG. 2, with the rotary piston 7 in the resting position. In the resting position, the channel 19 of the rotary piston 7 connects the working chamber A to the working chamber B. Since there are three such first pairs of working chambers comprising the two working chambers A and B in the circumferential direction, the channels 19 and hydraulic-medium channels AA and BB are associated to correspond to the number of first pair of working chambers.

An angular stop 8 of the rotary piston 7 is situated in a recess 26 of one of the vanes 6 of the first driven element 3. The angular stop 8 delimits a defined angular range. In the one angular-stop position shown here, the channel 19 of the rotary piston 7 allows hydraulic medium to flow through the hydraulic-medium channel AA or BB of the first driven element 3 out of the one working chamber A or B into the other working chamber B or A. Moreover, in this one angular-stop position shown for the rotary piston 7, a fillable volume of the actuation chambers 18 is maintained, so that, when the actuation chambers 18 are being filled, the hydraulic medium can flow in without being hindered and can move the rotary piston 7 in the direction of the other angular-stop position.

If hydraulic medium is fed to one of the working chambers of the second pair of working chambers and if the adjustment is to be made in the circumferential direction 17, then there is a need to remove the hydraulic medium that acts counter to the movement direction and that is present in one of the working chambers A, B of the first pair of working chambers. For this purpose, the channel 19 connects the working chambers A, B of the first pair of working chambers to each other, and the hydraulic medium present in the working chamber A or B whose size is to be reduced can flow into the other working chamber B or A.

Figure 6:
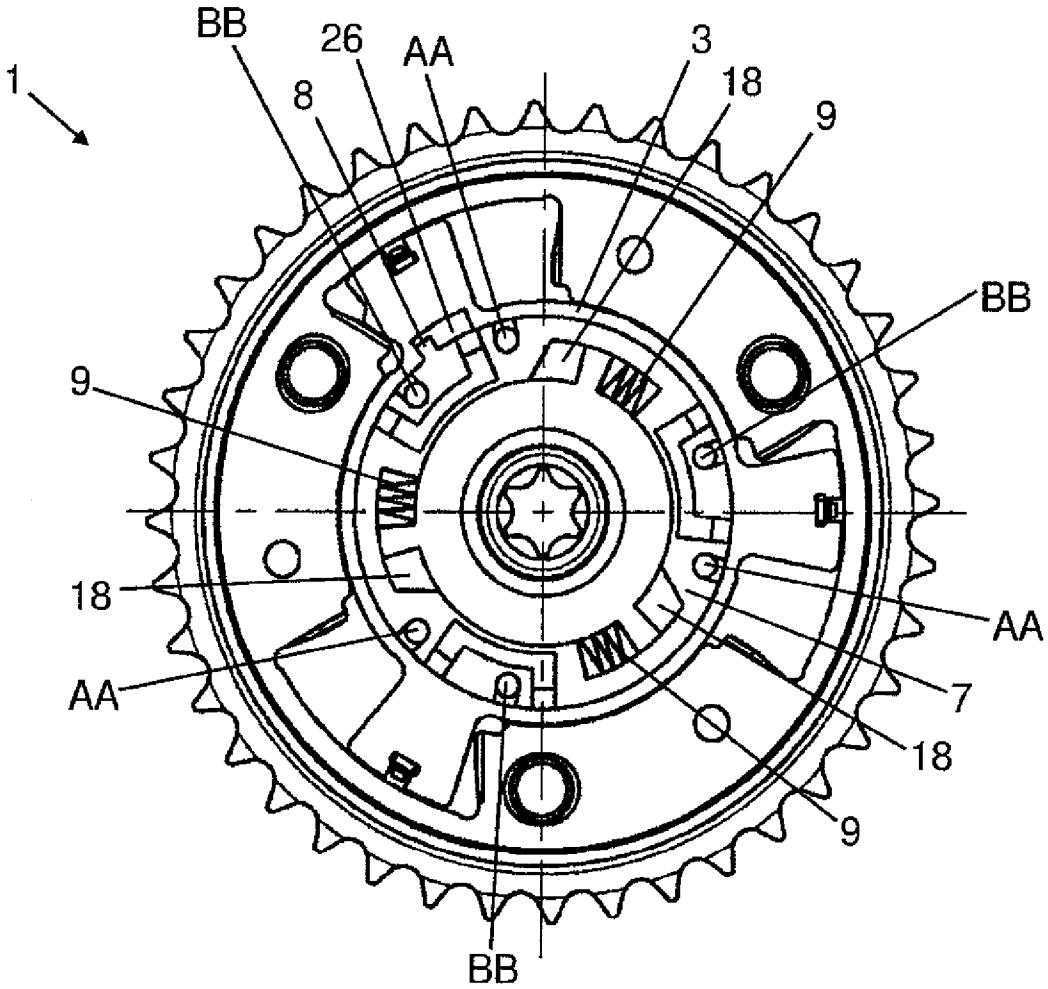
FIG. 6 a front view according to FIG. 2, with the rotary piston in the actuated state.

FIG. 6 shows a front view according to FIG. 2, with the rotary piston 7 in the actuated state. Another effective stop surface of the angular stop 8 is now in contact with the recess 26. In contrast to the one angular-stop position from FIG. 5, this other angular-stop position, which has been thus defined, positions the rotary piston 7 in such a way that it effectuates a fluid-conveying connection of the hydraulic-medium channels AA and BB to the second pair of working chambers that is arranged in the axial direction 23 adjacent to the first pair of working chambers. For this purpose, the hydraulic-medium channels AA and BB are made to coincide with the openings of the first driven element 3 and hydraulic medium can be exchanged between the first and second pair of working chambers.

When the actuation chambers 18 are being filled with hydraulic medium, the rotary piston 7 rotates relative to the first driven element 3. In this process, the spring means 9 are further pre-tensioned. Once the hydraulic medium has been emptied out of the actuation chambers 18, the energy stored in the spring means 9 is utilized to rotate the rotary piston 7 back to its resting position.

Figure 7:
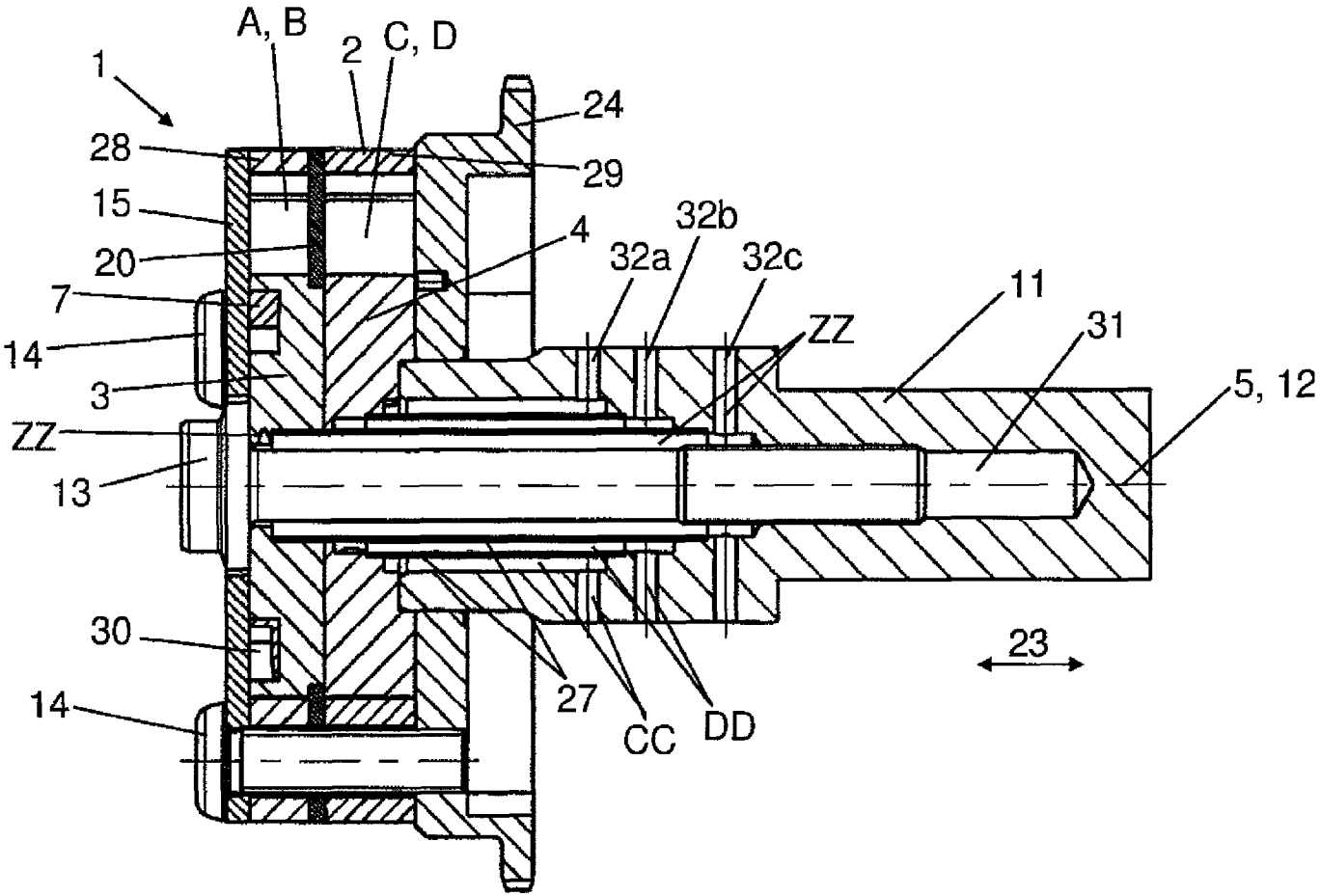
FIG. 7 a first longitudinal section through the camshaft phaser according to FIG. 1.

FIG. 7 shows a first longitudinal section through the camshaft phaser 1 according to FIG. 1. On the side of the camshaft phaser 1 facing away from the camshaft, the camshaft phaser 1 has the first driven element 3 arranged concentrically to the first stator part 28. The first driven element 3 has a circumferential groove 30 which is open in the axial direction 23 and in which the rotary piston 7 is situated. The end face of this groove 30 is covered by the disk 15, so that one degree of freedom for the rotary piston 7 remains in the circumferential direction 17, and an axial delimitation of the working chambers A, B is implemented. The second stator part 29 is located adjacent to the first stator part 28 in the axial direction 23. A gasket 20 is arranged between the first stator part 28 and the second stator part 29. The gasket 20 prevents a flow of hydraulic medium from the first pair of working chambers to the second pair of working chambers. The second driven element 4 is arranged concentrically to the second stator part 29. The first driven element 3 and the second driven element 4 contact each other directly. On the side of the camshaft phaser 1 facing the camshaft, the chain sprocket 24 closes off the assembly and delimits the working chambers C and D in the axial direction 23. The chain sprocket 24 contacts the second stator part 29 and the second driven element directly. This assembly is secured in the axial direction 23 by means of several screws 14. The end of the camshaft 11 passes through a concentric opening of the chain sprocket 24. The end face of the camshaft 11 contacts the second driven element 4. Moreover, the end of the camshaft 11 has a graduated, axial bore 31 and three radial bores 32*a*, 32*b* and 32*c*. The graduated bore 31 is concentric to the camshaft 11 and it has a diameter with a thread for the central screw 13, three diameters into which the radial bores 32*a*, 32*b* and 32*c* open up as well as surfaces for affixing hydraulic-medium bushings 27 that separate the hydraulic-medium channels CC, DD, ZZ from each other. The hydraulic-medium bushings 27 are arranged coaxially to each other and to the camshaft 11. The different diameters of the hydraulic-medium bushings 27 allow a separation of the hydraulic-medium channels CC, DD, ZZ and convey the hydraulic medium in the axial direction 23 to the hydraulic-medium channels CC, DD, ZZ of the first and second driven elements 3 and 4, respectively.

The hydraulic-medium channel CC comprises a radial bore 32*a* that is at the smallest distance from the camshaft phaser 1. This bore 32*a* opens up into an inner diameter of the graduated bore 31. The outer diameter of the hydraulic-medium bushing 27 is fastened to a smaller inner diameter of the graduated bore 31. Through the outer diameter of the hydraulic-medium bushing 27 and the inner diameter of the graduated bore 31 into which the bore 32*a* opens up, hydraulic medium can then be conveyed in the axial direction 23 to the hub of the second driven element 4. From there, the hydraulic-medium channel CC extends inside the second driven element 4 to the working chamber C.

The hydraulic-medium channel DD comprises another radial bore 32*b*. This bore 32*b* opens up into a smaller inner diameter of the graduated bore 31. The outer diameter of a smaller hydraulic-medium bushing 27 is fastened to another smaller inner diameter of the graduated bore 31. Through the outer diameter of the hydraulic-medium bushing 27 and the inner diameter of the larger hydraulic-medium bushing 27, hydraulic medium can then be conveyed in the axial direction 23 to the hub of the second driven element 4. From there, the hydraulic-medium channel DD extends inside the second driven element 4 to the working chamber D.

The hydraulic-medium channel ZZ is determined by another radial bore 32*c*. This bore 32*c* opens up into another, smaller inner diameter of the graduated bore 31. Via the inner diameter of the smaller hydraulic-medium bushing 27 and the outer diameter of the central screw 13, hydraulic medium can be conveyed through the hydraulic-medium channel ZZ in the axial direction 23 to the hub of the first driven element 3. From there, the hydraulic-medium channel ZZ extends inside the first driven element 3 to the actuation chambers 18.

The smallest diameter of the graduated bore 31 has a thread to receive the central screw 13. With this thread, the central screw 13 fastens the camshaft phaser 1 to the camshaft 11. For this purpose, the driven elements 3 and 4 are non-rotatably secured between the head of the central screw 13 and the end face of the camshaft 11.

Figure 8:
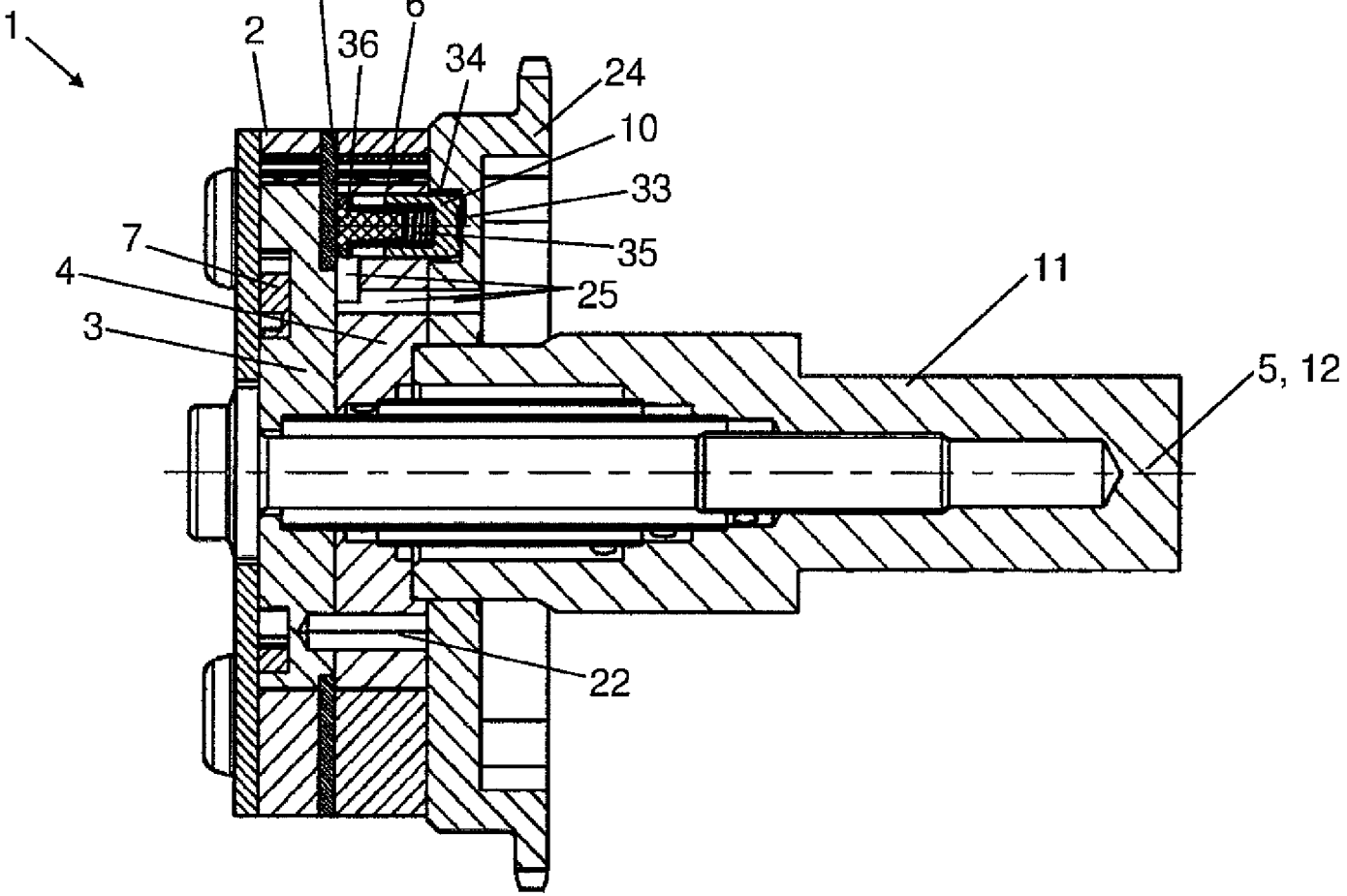
FIG. 8 a second longitudinal section through the camshaft phaser according to FIG. 1.

FIG. 8 shows a second longitudinal section through the camshaft phaser 1 according to FIG. 1. In the vane 6 of the second driven element 4, there is a passage opening in which the latching mechanism 10 is arranged. The latching mechanism 10 has a latching piston 33, a latching spring 35 and a latching cartridge 36. The chain sprocket 24 has a latching link 34 that is complementary to the latching piston 33, and the latching piston 33 can latch into this latching link 34, thus non-rotatably coupling the second driven element 4 to the chain sprocket 24. Between the two driven elements 3 and 4, there is a non-rotatable connection created by the use of several pins 22. The second driven element 4 has a vent 25. The vent 25 extends over a groove provided for this purpose, over passage openings of the second driven element 4 as well as over passage openings of the chain sprocket 24 to the side of the camshaft phaser 1 facing the camshaft. In this manner, foreign matter can be conveyed out of the spring chamber where the latching spring 35 is located and discharged to the environment. The latching spring 35 is arranged between the latching cartridge 36 and the latching piston 33 and, due to its pretensioning, it pushes both elements apart. The exertion of hydraulic-medium pressure onto the latching piston 33 causes the latter to move to the latching cartridge 36 and the latching spring 35 to be tensioned. As a result, the second driven element 4 can be uncoupled from the chain sprocket 24. The latching cartridge 36 is supported on the gasket 20.

Figure 9:
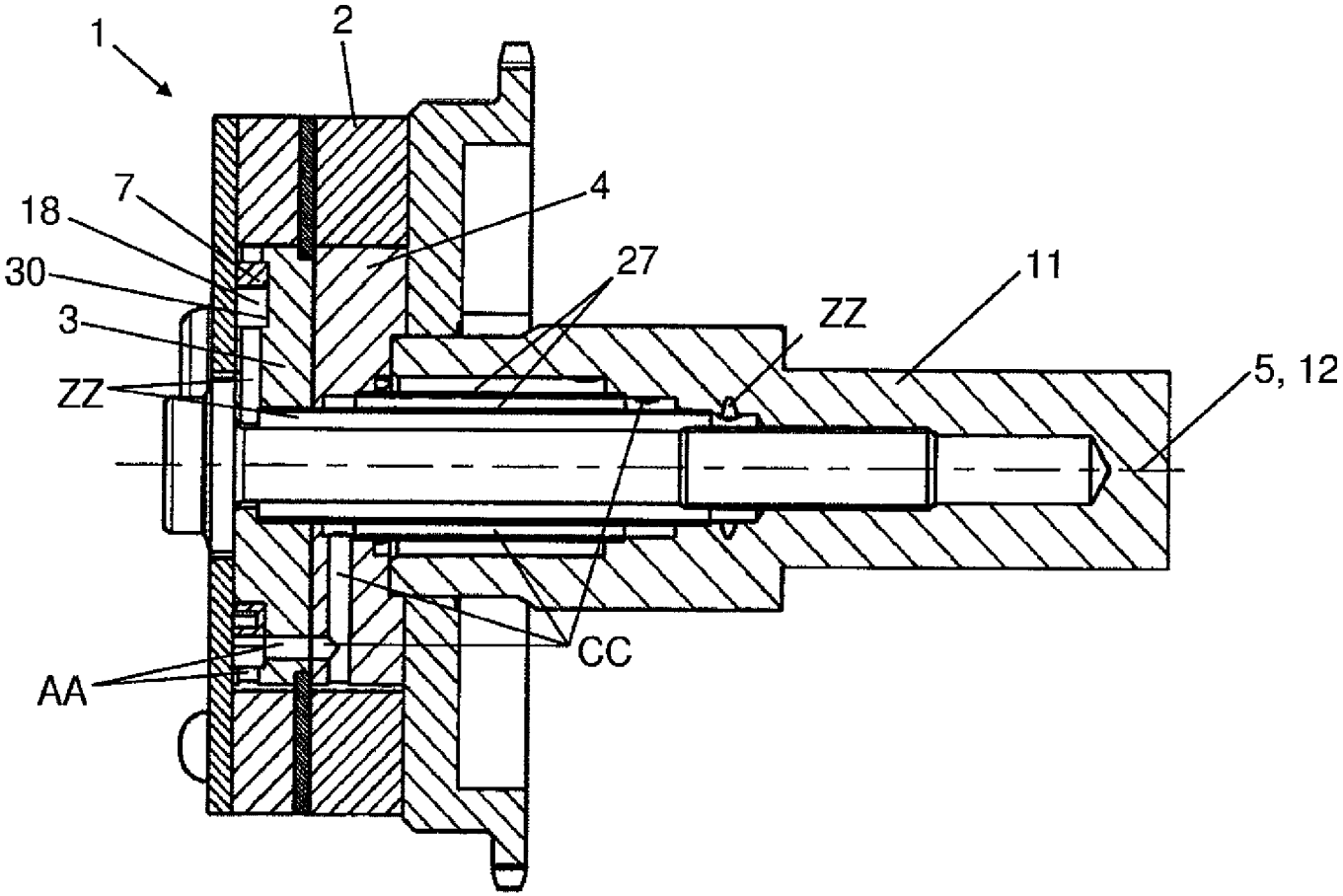
FIG. 9 a third longitudinal section through the camshaft phaser according to FIG. 1.

FIG. 9 shows a third longitudinal section through the camshaft phaser 1 according to FIG. 1. The rotary piston 7 is actuated by filling the actuation chambers 18 with hydraulic medium, and the spring elements 9 are tensioned, as shown in FIG. 2. The flow of hydraulic medium through the hydraulic-medium channel ZZ out of the camshaft 11 to the first driven element 3 was explained in FIG. 7. The extension of the hydraulic-medium channel ZZ to the actuation chambers 18 can be seen in this third longitudinal section. The smaller hydraulic-medium bushing 27 opens up into the hub of the first driven element 3. Adjoining each opening, there is a radial bore in the first driven element 3 that extends from the hub to the appertaining actuation chamber 18.

The hydraulic-medium channel CC, partially formed by the lateral surfaces of the two concentric hydraulic-medium bushings 27, opens up into the hub of the second driven element 4. Adjoining the opening, there is a radial bore in the second driven element 4 that extends from the hub to the appertaining working chamber C. Branching off from this radial bore, there is a bore that is axis-parallel to the rotational axis 5, 12, extending to the end face of the second driven element 4 facing away from the camshaft. Opposite to the second driven element 4, there is another bore that is configured axis-parallel to the rotational axis 5, 12, the hydraulic-medium channel AA, of the first driven element 3, so that hydraulic medium can be conveyed from the second driven element 4 to the first driven element 3. The hydraulic-medium channel AA comprises the groove 30 in which the rotary piston 7 is located. In FIG. 9, the rotary piston 7 is in the position that allows hydraulic medium to flow from the working chamber C or from the hydraulic-medium channel CC via the hydraulic-medium channel AA to the working chamber A. If the hydraulic-medium channel CC is connected by a control valve to the hydraulic-medium circuit, then the working chambers A and C are simultaneously filled with hydraulic medium or emptied of hydraulic medium. If there is no hydraulic medium or hydraulic-medium pressure in the hydraulic-medium channel ZZ, then the rotary piston 7 is in the resting position and it blocks the hydraulic-medium channel AA. In this context, only the working chamber C is filled or emptied in response to an appropriate actuation of the control valve.

Figure 10:
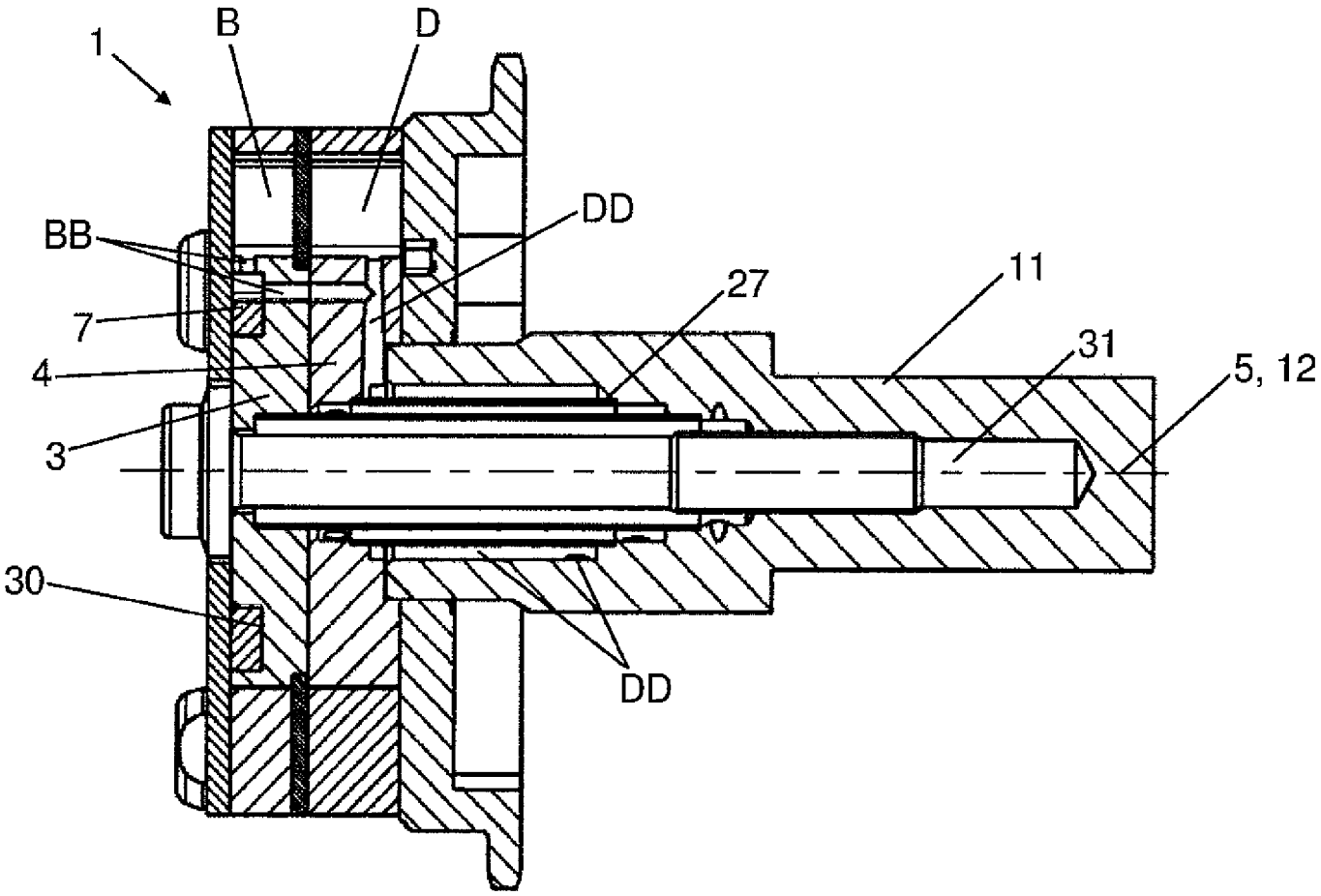
FIG. 10 a fourth longitudinal section through the camshaft phaser according to FIG. 1.

FIG. 10 shows a fourth longitudinal section through the camshaft phaser 1 according to FIG. 1. The hydraulic-medium channel DD, partially formed by the lateral surfaces of the larger hydraulic-medium bushing 27 together with the inner diameter of the graduated bore 31, opens up into the hub of the second driven element 4. Adjoining the opening, there is a radial bore in the second driven element 4 that extends from the hub to the appertaining working chamber D. Branching off from this radial bore, there is a bore that is axis-parallel to the rotational axis 5, 12, extending to the end face of the second driven element 4 facing away from the camshaft. Opposite to the second driven element 4, there is another bore that is configured axis-parallel to the rotational axis 5, 12, the hydraulic-medium channel BB, of the first driven element 3, so that hydraulic medium can be conveyed from the second driven element 4 to the first driven element 3. The hydraulic-medium channel BB comprises the groove 30 in which the rotary piston 7 is located. In FIG. 10, the rotary piston 7 is in the position that allows hydraulic medium to flow from the working chamber D or from the hydraulic-medium channel DD via the hydraulic-medium channel BB to the working chamber B. If the hydraulic-medium channel DD is connected by a control valve to the hydraulic-medium circuit, then the working chambers B and D are simultaneously filled with hydraulic medium or emptied of hydraulic medium. If there is no hydraulic medium or hydraulic-medium pressure in the hydraulic-medium channel ZZ, then the rotary piston 7 is in the resting position and it blocks the hydraulic-medium channel BB. In this context, only the working chamber D is filled or emptied in response to an appropriate actuation of the control valve.

LIST OF REFERENCE NUMERALS

1 camshaft phaser
2 drive element

3 first driven element
4 second driven element
5 rotational axis
6 vane
7 rotary piston
8 angular stop
9 spring element
10 latching mechanism
11 camshaft
12 rotational axis
13 central screw
14 screws
15 disk
16 spring-loaded sealing strips
17 circumferential direction
18 actuation chambers
19 channel
20 gasket
21 pin
22 pin
23 axial direction
24 chain sprocket
25 vent
26 recess
27 hydraulic-medium bushing
28 first stator part
29 second stator part
30 groove
31 graduated bore
32*a* radial bore
32*b* radial bore
32*c* radial bore
33 latching piston
34 latching link
35 latching spring
36 latching cartridge
37 latching hydraulic-medium channel
38 recesses
A working chamber
B working chamber
C working chamber
D working chamber
AA hydraulic-medium channel to the working chamber A
BB hydraulic-medium channel to the working chamber B
CC hydraulic-medium channel to the working chamber C
DD hydraulic-medium channel to the working chamber D
ZZ hydraulic-medium channel to the actuation chambers

What is claimed is:

1. A camshaft phaser comprising:

a drive element;

a first driven element; and a second driven element, each of the drive, first driven and second driven elements being arranged coaxially to a rotational axis of the camshaft phaser, the first and second driven elements and the drive element having several radially oriented vanes forming several working chambers pressurizable with a hydraulic medium so that a relative rotation is possible between the drive element and one of the first and second driven elements; and a rotary piston for purposes of controlling the pressure charging of the working chambers, the rotary piston arranged with a piston rotational axis axis-parallel to the rotational axis and opening or closing hydraulic medium-channels by rotating around the piston rotational axis.

2. The camshaft phaser as recited in claim 1 wherein the rotary piston is actuated by hydraulic-medium pressure.

3. The camshaft phaser as recited in claim 1 wherein the rotary piston connects a first pair of working chambers formed by the first driven element together with the drive element to a second pair of working chambers formed by the second driven element together with the drive element so that fluid can flow through.

4. The camshaft phaser as recited in claim 1 wherein the rotary piston connects two working chambers of a first pair of working chambers formed by the first driven element together with the drive element or two working chambers of a second pair of working chambers formed by the second driven element together with the drive element so that fluid can flow through.

5. The camshaft phaser as recited in claim 1 wherein the first and second driven elements are non-rotatably coupled to each other.

6. The camshaft phaser as recited in claim 1 wherein the rotary piston (7) is arranged coaxially to one of the first and second driven elements or to the drive element.

7. The camshaft phaser as recited in claim 1 further comprising a spring element moving the rotary piston into a resting position.

8. The camshaft phaser as recited in claim 1 further comprising an angular stop between the rotary piston and one of the first and second driven elements.

9. The camshaft phaser as recited in claim 1 further comprising a latch non-rotatably coupling one of the first and second driven elements to the drive element.

10. The camshaft phaser as recited in claim 1 herein the rotary piston is mounted on a camshaft.

11. The camshaft phaser as recited in claim 1 wherein the first and second driven elements are rotatable relative to each other.

* * * * *